US011131939B2

(12) United States Patent
Hama et al.

(10) Patent No.: US 11,131,939 B2
(45) Date of Patent: Sep. 28, 2021

(54) TONER

(71) Applicant: CANON KABUSHIKI KAISHA, Tokyo (JP)

(72) Inventors: Masayuki Hama, Toride (JP); Yuto Onozaki, Saitama (JP); Takeshi Hashimoto, Moriya (JP); Megumi Shino, Kashiwa (JP); Ichiro Kanno, Kashiwa (JP); Nozomu Komatsu, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/550,410

(22) Filed: Aug. 26, 2019

(65) Prior Publication Data

US 2020/0073263 A1 Mar. 5, 2020

(30) Foreign Application Priority Data

Aug. 28, 2018 (JP) ..... JP2018-159465

(51) Int. Cl.
*G03G 9/083* (2006.01)
*G03G 9/08* (2006.01)
*G03G 9/087* (2006.01)

(52) U.S. Cl.
CPC ..... *G03G 9/0838* (2013.01); *G03G 9/081* (2013.01); *G03G 9/0819* (2013.01); *G03G 9/0823* (2013.01); *G03G 9/0832* (2013.01); *G03G 9/0833* (2013.01); *G03G 9/0839* (2013.01); *G03G 9/08755* (2013.01)

(58) Field of Classification Search
CPC ..... G03G 9/0838; G03G 9/0819; G03G 9/08755; G03G 9/0823; G03G 9/0833; G03G 9/0832; G03G 9/0839; G03G 9/081; G03G 9/09766; G03G 9/0827; G03G 9/0821; G03G 9/09716; G03G 9/09791; G03G 9/09708
See application file for complete search history.

(56) References Cited

U.S. PATENT DOCUMENTS 5,968,701 A 10/1999 Onuma et al.
5,976,750 A * 11/1999 Hagi ..... G03G 9/09708 430/108.6
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,335,135 B1 * 1/2002 Arai ..... G03G 9/0819 430/108.6
6,430,384 B2 8/2002 Hama et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
6,905,808 B2 6/2005 Itakura et al.
7,112,395 B2 9/2006 Ida et al.
7,135,263 B2 11/2006 Kawakami et al.
7,147,980 B2 12/2006 Itakura et al.
7,147,981 B2 12/2006 Fujikawa et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,361,441 B2 4/2008 Itakura et al.
7,396,626 B2 7/2008 Fujikawa et al.
7,396,629 B2 7/2008 Baba et al.
7,442,478 B2 10/2008 Itakura et al.
7,452,647 B2 11/2008 Hayami et al.
7,611,813 B2 11/2009 Ida et al.
7,858,283 B2 12/2010 Ishigami et al.
7,927,775 B2 4/2011 Komatsu et al.
7,939,233 B2 5/2011 Inoue et al.
8,137,886 B2 3/2012 Baba et al.
8,142,972 B2 3/2012 Hotta et al.
8,288,069 B2 10/2012 Fujikawa et al.
(Continued)

FOREIGN PATENT DOCUMENTS

JP 2010-002748 1/2010
JP 2012-149169 8/2012
JP 2013-190646 9/2013

OTHER PUBLICATIONS

U.S. Appl. No. 16/438,537, Kentaro Kamae, filed Jun. 12, 2019.
(Continued)

*Primary Examiner* — Peter L Vajda
(74) *Attorney, Agent, or Firm* — Venable LLP

(57) ABSTRACT

A toner including a toner particle that contains a binder resin, and an inorganic fine particle, wherein the inorganic fine particle contains aggregated particles; the aggregated particles contain primary particles of at least one metal salt selected from the group consisting of titanate metal salts and zirconate metal salts; the primary particles have a number-average particle diameter of from 15 nm to 55 nm; the aggregated particles have an aggregation diameter of from 80 nm to 300 nm, the aggregated particles have a volume resistivity of from $2\times10^{9}$ Ω·cm to $2\times10^{13}$ Ω·cm; and the aggregated particles cover a surface of the toner particle, and a coverage ratio of the aggregated particles with respect to the surface of the toner particle is from 0.3 area % to 10.0 area %.

9 Claims, No Drawings

(56) References Cited

U.S. PATENT DOCUMENTS

| | | | |
|---|---|---|---|
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,256,148 | B2 | 2/2016 | Fujikawa et al. |
| 9,348,253 | B2 | 5/2016 | Kanno et al. |
| 9,394,413 | B2 | 7/2016 | Yoshikawa et al. |
| 9,417,540 | B2 | 8/2016 | Hashimoto et al. |
| 9,436,112 | B2 | 9/2016 | Iwasaki et al. |
| 9,500,975 | B2 | 11/2016 | Sugahara et al. |
| 9,599,920 | B2 | 3/2017 | Sugahara et al. |
| 9,651,883 | B2 | 5/2017 | Hama et al. |
| 9,665,023 | B2 | 5/2017 | Kamae et al. |
| 9,665,026 | B2 | 5/2017 | Iwasaki et al. |
| 9,778,598 | B2 | 10/2017 | Onozaki et al. |
| 9,958,809 | B2 | 5/2018 | Sugahara et al. |
| 10,036,970 | B2 | 7/2018 | Kanno et al. |
| 10,082,743 | B2 | 9/2018 | Hama et al. |
| 10,146,146 | B2 | 12/2018 | Komatsu et al. |
| 10,175,595 | B2 | 1/2019 | Onozaki et al. |
| 10,197,936 | B2 | 2/2019 | Onozaki et al. |
| 10,274,851 | B2 | 4/2019 | Hashimoto et al. |
| 10,401,748 | B2 | 9/2019 | Hashimoto et al. |
| 10,423,086 | B2 | 9/2019 | Hama et al. |
| 10,451,986 | B2 | 10/2019 | Sano et al. |
| 10,474,049 | B2 | 11/2019 | Onozaki et al. |
| 2009/0197190 | A1 | 8/2009 | Nakamura et al. |
| 2010/0028796 | A1 | 2/2010 | Nakamura et al. |
| 2010/0183971 | A1 | 7/2010 | Fujikawa et al. |
| 2013/0244159 | A1 | 9/2013 | Ishigami et al. |
| 2013/0288173 | A1 | 10/2013 | Hashimoto et al. |
| 2014/0134535 | A1 | 5/2014 | Baba et al. |
| 2014/0329176 | A1 | 11/2014 | Kanno et al. |
| 2014/0342277 | A1* | 11/2014 | Ohmori ..... G03G 9/0832 430/108.3 |
| 2015/0104739 | A1 | 4/2015 | Nagatomo et al. |
| 2017/0315463 | A1 | 11/2017 | Onozaki et al. |
| 2018/0246429 | A1* | 8/2018 | Takahashi ..... G03G 9/0819 |
| 2018/0246432 | A1* | 8/2018 | Nishikawa ..... G03G 9/0819 |
| 2018/0314176 | A1 | 11/2018 | Ikeda et al. |
| 2018/0364601 | A1 | 12/2018 | Onozaki et al. |
| 2019/0033737 | A1* | 1/2019 | Iguchi ..... G03G 9/0819 |
| 2019/0033740 | A1* | 1/2019 | Iguchi ..... G03G 9/1132 |
| 2019/0171125 | A1 | 6/2019 | Kanno et al. |

OTHER PUBLICATIONS

U.S. Appl. No. 16/438,541, Takeshi Hashimoto, filed Jun. 12, 2019.
U.S. Appl. No. 16/438,544, Kazuhisa Shirayama, filed Jun. 12, 2019.
U.S. Appl. No. 16/539,245, Ryuji Murayama, filed Aug. 13, 2019.
U.S. Appl. No. 16/686,760, Yuto Onozaki, filed Nov. 18, 2019.
U.S. Appl. No. 16/701,265, Ichiro Kanno, filed Dec. 3, 2019.

* cited by examiner

TONER

BACKGROUND OF THE INVENTION

Field of the Invention

The present invention relates to a toner that is used in electrophotographic systems, electrostatic recording systems, electrostatic printing systems, and toner jet systems.

Description of the Related Art

Ever higher performance is demanded from toner, as the use of copiers and printers has become widespread. Recent years have witnessed growing interest in so-called print on-demand (POD) i.e. digital printing technologies for direct printing without a plate making process. Print-on demand (POD) is suited to small-batch printing, printing in which the printed content changes with each sheet (variable printing), and distributed printing. Print-on demand (POD) is therefore advantageous over conventional offset printing.

In addressing the use of image-forming methods reliant on toner in the POD market, a need arises for obtaining stably, over long periods of time, printed products of high image quality that are outputted at high speed and in large quantities.

Numerous schemes have been proposed thus far that involve adding large-diameter particles, capable of imparting a spacer effect to a toner particle, with a view to preserving long-term stable flowability.

For instance, Japanese Patent Application Publication No. 2012-149169 proposes preserving toner flowability by adding, to a toner particle, a differently-shaped silica particle formed in accordance with a sol-gel method.

Japanese Patent Application Publication No. 2013-190646 discloses a technology wherein toner durability is improved by relying on a toner containing non-spherical particles onto which primary particles have coalesced.

Japanese Patent Application Publication No. 2010-002748 discloses the feature of improving on transfer misses, and fogging, by an image-forming method that involves specifying the characteristics of a toner that utilizes aggregated particles having a size of from 50 nm to 300 nm, and the characteristics of an intermediate transfer member.

SUMMARY OF THE INVENTION

However, in the case of image output in a low-humidity environment and over long periods of time, toner scattering occurs in a transfer step, and dot reproducibility is poor, even using conventional toner using large-size fine particles which are capable of imparting the spacer effect. There is thus further room for improvement as regards preservation of image quality as impacted by humid environments and usage by a user.

One aspect of the present invention is directed to providing a toner that allows obtaining stable images over long periods of time, also when image formation is carried out under various temperature and humidity environments.

According to one aspect of the present invention, there is provided a toner including a toner particle that contains a binder resin, and an inorganic fine particle, wherein the inorganic fine particle contains aggregated particles;

the aggregated particles contain primary particles of at least one metal salt selected from the group consisting of titanate metal salts and zirconate metal salts;

the primary particles have a number-average particle diameter of from 15 nm to 55 nm;

the aggregated particles have an aggregation diameter of from 80 nm to 300 nm;

the aggregated particles have a volume resistivity of from $2\times10^{9}$ Ω·cm to $2\times10^{13}$ Ω·cm; and the aggregated particles cover a surface of the toner paeticle, and a coverage ratio of the aggregated particles with respect to the surface of the toner particle is from 0.3 area % to 10.0 area %.

One aspect of the present invention allows providing a toner thanks to which stable images are obtained over long periods of time, also when image formation is carried out under various temperature and humidity environments.

Further features of the present invention will become apparent from the following description of exemplary embodiments.

DESCRIPTION OF THE EMBODIMENTS

Unless otherwise stated, the notations "from XX to YY" and "XX to YY" representing a numerical range in the present invention denote a range that includes the lower limit and the upper limit thereof, as endpoints.

The present invention relates to a toner including a toner particle that contains a binder resin, and an inorganic fine particle, wherein the inorganic fine particle contains aggregated particles;

the aggregated particles contain primary particles of at least one metal salt selected from the group consisting of titanate metal salts and zirconate metal salts;

the primary particles have a number-average particle diameter of from 15 nm to 55 nm;

the aggregated particles have an aggregation diameter of from 80 nm to 300 nm;

the aggregated particles have a volume resistivity of from $2\times10^{9}$ Ω·cm to $2\times10^{13}$ Ω·cm; and the aggregated particles cover a surface of the toner paeticle, and a coverage ratio of the aggregated particles with respect to the surface of the toner particle is from 0.3 area % to 10.0 area %.

The use of the above toner makes it possible to obtain stable images also under various temperature and humidity environments.

The inventors estimated that the following mechanism underlies this effect.

Rolling on the toner particle surface is limited in inorganic fine particles that contain aggregated particles having a specific volume resistivity. In consequence, uneven distribution of the aggregated particles is suppressed on account of a more sluggish movement on the toner particle surface, even when a load is applied to the toner. As a result stable images can be obtained over long periods of time even when formed in various temperature and humidity environments, and under various conditions. For instance in a transfer step, electrostatic adhesion of the toner can be reduced thanks to the presence of the aggregated particles on the toner particle surface. In consequence, transfer scattering in low-humidity environment is improved and dot reproducibility significantly enhanced, in particular.

For instance even upon scattering of toner on a white background portion of an image on an image bearing member, in the developing step, toner is recovered readily from the white background portion on the image on the image bearing member, and occurrence of fogging is suppressed, on the second half of the developing step (downstream of a developing nip). Further, the aggregated particles have a property of leaking accumulated charge moderately, so that the quantity of charge on the toner surface is unlikely to be excessive, which contributes to stabilized image density even when images are formed continuously.

The toner contains an inorganic fine particle.

The inorganic fine particle contains aggregated particles.

The aggregated particles contain primary particles of at least one metal salt selected from the group consisting of titanate metal salts and zirconate metal salts. The aggregated particles may be aggregates of primary particles of a metal salt.

The primary particles of the metal salt have a number-average particle diameter of from 15 nm to 55 nm, preferably from 20 nm to 45 nm.

The aggregated particles have an aggregation diameter of from 80 nm to 300 nm, preferably from 95 nm to 250 nm.

In a case where the aggregation diameter of the aggregated particles lies within the above ranges, an effect of relaxing electrostatic adhesion at contact points between the aggregated particles and the image bearing member is exhibited.

In a case where the number-average particle diameter of the primary particles of a metal salt lies within the above range, the aggregated particles take on an uneven shape, and do not move readily over a toner particle. For instance an image can be transferred stably in a transfer step.

A ratio of the number-average particle diameter of the primary particles of a metal salt with respect to the aggregation diameter of the aggregated particles is preferably from 0.05 to 0.69, more preferably from 0.10 to 0.50, and yet more preferably from 0.15 to 0.45.

The average circularity of the aggregated particles is preferably from 0.720 to 0.950, more preferably from 0.740 to 0.940, yet more preferably from 0.760 to 0.920 and particularly preferably from 0.780 to 0.910.

The aggregated particles may be aggregates of primary particles of a metal salt, but preferably the aggregated particles are a reaction product of primary particles of a metal salt, through the use of a binder agent.

Preferably, the aggregated particles contain a reaction product of primary particles of a metal salt and at least one compound selected from the group consisting of fatty acids and metal salts thereof, silicone compounds, silane compounds, and titanium compounds.

These compounds have hydrophobicity and are preferable in terms of affording environment stability pertaining to charging, and improving durability stability in high-temperature high-humidity environments.

Examples of the fatty acid or metal salt thereof include sodium stearate, magnesium stearate, calcium laurate and barium laurate.

Examples of the silicone compound include silicone oils.

Examples of the silane compound include organosilane compounds represented by Formula (1) below; fluorine-containing silane compounds such as fluoroalkyl silanes and fluoroaryl silanes; silanes; halogenated silanes such as dichlorosilane; and silazanes such as hexamethyldisilazane (HMDS).

$$R_mSiY_n \quad (1)$$

Where, R represents an alkoxy group (preferably a methoxy group, an ethoxy group, a propoxy group or a butoxy group); m represents an integer from 1 to 3; Y represents an alkyl group having 1 to 10 carbon atoms, a phenyl group, a vinyl group, an epoxy group, a methacryl group, or an acryl group; and n is an integer from 1 to 3; provided that m+n=4.

Examples of the titanium compound include titanium coupling agents.

Preferably, the aggregated particles contain a reaction product of the primary particles of a metal salt and at least one compound selected from the group consisting of organosilane compounds represented by Formula (1) and fluorine-containing silane compounds.

Examples of organosilane compounds represented by Formula (1) include octyltriethoxysilane and isobutyltrimethoxysilane. The foregoing can be used singly, or alternatively, two or more types may be used concomitantly.

Examples of fluorine-containing silane compounds include chlorodimethyl(3,3,4,4,5,5,6,6,7,7,8,8,8-tridecafluoro-n-octyl)silane, chlorodimethyl[3-(2,3,4,5,6-pentafluorophenyl)propyl]silane, chloro(3,3,4,4,5,5,6,6,7,7,8,8,9,9,10,10,10-heptadecafluorodecyl)dimethylsilane, (3,3,3-trifluoropropyl)methyldichlorosilane, 1,1,1-trifluoro-3-[dimethoxy(methyl)silyl]propane, dimethylpentafluorophenylchlorosilane, ethoxy(pentafluorophenyl)dimethylsilane, 1H,1H,2H,2H-tridecafluoro-n-octyltriethoxysilane, trichloro(1H,1H,2H,2H-tridecafluoro-n-octyl)silane, trichloro(1H,1H,2H,2H-heptadecafluorodecyl)silane, trimethoxy(3,3,3-trifluoropropyl)silane, 1H,1H,2H,2H-nonafluorohexyltriethoxysilane, triethoxy-1H,1H,2H,2H-heptadecafluorodecylsilane, trimethoxy(1H,1H,2H,2H-heptadecafluorodecyl)silane, trimethoxy(1H,1H,2H,2H-nonafluorohexyl)silane, trichloro[3-(pentafluorophenyl)propyl]silane, triethoxy(pentafluorophenyl)silane, trimethoxy(11-pentafluorophenoxyundecyl)silane, triethoxy[5,5,6,6,7,7,7-heptafluoro-4,4-bis(trifluoromethyl)heptyl]silane, trimethoxy(pentafluorophenyl)silane, trichloro(3,3,3-trifluoropropyl)silane, and trimethoxy(1H,1H,2H,2H-tridecafluoro-n-octyl)silane. The foregoing can be used singly, or alternatively, two or more types may be used concomitantly.

As described above, the aggregated particles contain primary particles of at least one a metal salt selected from the group consisting of titanate metal salts and zirconate metal salts.

Preferably, the aggregated particles contain primary particles of at least one metal salt selected from the group consisting of strontium titanate, calcium titanate, magnesium titanate, strontium zirconate, calcium zirconate, and magnesium zirconate, more preferably primary particles of strontium titanate.

The aggregated particles have a volume resistivity of from $2.0\times10^{9}$ Ω·cm to $2.0\times10^{13}$ Ω·cm, preferably from $1.0\times10^{10}$ Ω·cm to $1.0\times10^{12}$ Ω·cm.

The volume resistivity of the aggregated particles within the above ranges makes it possible to obtain a sharper charge quantity distribution and to improve transfer uniformity, while controlling charge injection due to transfer bias. Rolling on the toner particle surface is also limited thereby. In consequence, uneven distribution is suppressed as a result of a more sluggish movement on the toner particle surface, even when a load is applied to the toner. Stable images can therefore be obtained over long periods of time even when formed in various temperature and humidity environments, and under various conditions.

The volume resistivity of the aggregated particles can be controlled as a result of a hydrophobization treatment, for instance in terms of the degree of addition of the binder agent.

The aggregated particles cover a surface of the toner particle, and a coverage ratio of the aggregated particles with respect to the toner particle surface is from 0.3 area % to 10.0 area %, preferably from 0.5 area % to 5.0 area %.

The coverage ratio within such ranges makes it possible to provide stable images over long periods of time, even when formed in various temperature and humidity environments, and under various conditions.

As regards the inorganic fine particles, herein inorganic fine particles other than the aggregated particles may be added with a view to adjusting charging performance and flowability. Examples of inorganic fine particles other than the aggregated particles include silica fine particles, titanium oxide fine particles, aluminum oxide fine particles, magnesium oxide fine particles and calcium carbonate fine particles.

The fine particles are preferably hydrophobized using a hydrophobizing agent such as a silane compound, a silicone oil or a mixture thereof. The addition amount of the fine particles is preferably from 0.1 parts by mass to 10.0 parts by mass with respect to 100 parts by mass of the toner particle.

In the case for instance where silica fine particles are incorporated as inorganic fine particles other than the aggregated particles, the content of the aggregated particles among the inorganic fine particles may be from 0.02 times to 5.00 times (more preferably from 0.05 times to 2.00 times) the content of the silica fine particles, from the viewpoint of charging assistance.

The content of the aggregated particles is preferably from 0.10 parts by mass to 10.00 parts by mass, more preferably from 0.20 parts by mass to 5.00 parts by mass, with respect to 100 parts by mass of the toner particle.

Although not particularly limited to, a known mixer such as a Henschel mixer, Mechano Hybrid (by Nippon Coke & Engineering Co., Ltd.), a super mixer or Nobilta (by Hosokawa Micron Corporation) can be used for mixing of the toner particle and the aggregated particles.

The method for producing the titanate metal salt and the zirconate metal salt is not particularly limited, and the foregoing may be obtained in accordance with the below-described-methods.

In the case of strontium titanate, a mineral acid-deflocculated product of a hydrolysate of a titanium compound can be used as a titanium oxide source. Preferably, it is preferable to use a product resulting from deflocculation of metatitanic acid, having a $SO_3$ content of 1.0 mass % or less, and preferably 0.5 mass % or less, and obtained in accordance with a sulfuric acid method, by adjusting the pH of the metatitanic acid to from 0.8 to 1.5 using hydrochloric acid.

A metal nitrate salt or hydrochloride salt can be used as the metal salt source, and or instance, strontium nitrate and strontium chloride can be used.

A caustic alkali, preferably an aqueous solution of sodium hydroxide, can be used as the aqueous alkaline solution.

Factors that affect particle diameter in the production of strontium titanate include a mixing ratio of the titanium oxide source and a strontium oxide source during the reaction, the concentration of the titanium oxide source at the start of the reaction, and the temperature and addition rate during addition of an aqueous alkaline solution.

These factors may be adjusted as appropriate in order to obtain the desired particle diameter and particle diameter distribution. Intrusion of carbon dioxide is preferably prevented for instance by conducting reactions in a nitrogen gas atmosphere, in order to prevent formation of carbonate salts during the reaction process.

Factors that affect volume resistivity in the production of strontium titanate include conditions and operations involved in breakdown of particle crystallinity. To obtain in particular strontium titanate of high volume resistivity, it is preferable to perform an operation of imparting energy so as to disturb crystal growth, in a state where the concentration of the reaction solution has been raised. One concrete method involves for instance micro-bubbling with nitrogen during a crystal growth process. The content of particles with cubic and cuboid shapes can also be controlled on the basis of the flow rate of nitrogen micro-bubbling.

The mixing ratio of the titanium oxide source and strontium oxide source during the reaction preferably lies in the range of from 0.90 to 1.40, and more preferably in the range of from 1.05 to 1.20 in terms of molar ratio of $SrO/TiO_2$. Within the above ranges, residual unreacted titanium oxide is unlikelier to be present. The concentration of the titanium oxide source at the beginning of the reaction is preferably from 0.05 mol/L to 1.3 mol/L, more preferably from 0.08 mol/L to 1.0 mol/L, as $TiO_2$.

The temperature at the time of addition of the aqueous alkaline solution is preferably from 60° C. to 100° C. The lower the addition rate of the aqueous alkaline solution, the larger the particle diameter of the resulting strontium titanate becomes, whereas the higher the addition rate, the smaller the particle diameter of the resulting strontium titanate becomes. The addition rate of the aqueous alkaline solution is preferably from 0.001 eq/h to 1.2 eq/h, more preferably from 0.002 eq/h to 1.1 eq/h, with respect to the charge materials, and may be adjusted as appropriate depending on the particle diameter to be obtained.

The strontium titanate obtained as a result of a normal-pressure heating reaction is preferably further subjected to an acid treatment. In a case where, when obtaining strontium titanate as a result of a normal-pressure heating reaction, the mixing ratio of the titanium oxide source and the strontium oxide source exceeds 1.00, as $SrO/TiO_2$ molar ratio, a metal source other than unreacted titanium and which remains after the reaction is over may react with carbon dioxide in air, thereby giving rise to impurities such as metal carbonate salts. Impurities such as metal carbonate salts remaining on the surface have an impact on addition of the binder agent, in that the effect of the binder agent cannot be sufficiently brought out as a result. It is therefore preferable to perform an acid treatment in order to remove an unreacted metal source, after addition of the aqueous alkaline solution.

In the acid treatment, pH may be preferably adjusted to be from 2.5 to 7.0, more preferably to be from 4.5 to 6.0, using hydrochloric acid. Examples of the acid that can be used, besides hydrochloric acid, include for instance nitric acid and acetic acid.

The toner particle contains a binder resin. The binder resin is not particularly limited, and the following polymers and resins can be used as the binder resin:

monopolymers of styrene or substitution products thereof, such as polystyrene, poly-p-chlorostyrene and polyvinyl toluene; styrene-based copolymers such as styrene-p-chlorostyrene copolymers, styrene-vinyl toluene copolymers, styrene-vinyl naphthalene copolymers, styrene-acrylate ester copolymers, styrene-methacrylate ester copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers; as well as polyvinyl chloride, phenolic resins, natural modified phenolic resins, natural resin-modified maleic resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins and petroleum resins.

Among the foregoing, polyester resins are preferably used in terms of low-temperature fixability and control of charging of performance.

The polyester resin is preferably a resin having a "polyester segment" in a binder resin chain. Concrete examples of the components that make up the polyester segment include divalent or higher alcohol monomer components, and acid monomer components such as divalent or higher carboxylic acids, divalent or higher carboxylic acid anhydrides, and divalent or higher carboxylic acid esters.

Examples of divalent or higher alcohol monomer components include the following:

bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; as well as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene.

Aromatic diols are preferred among the foregoing; the content of aromatic diol in the alcohol monomer component that makes up the polyester resin is preferably from 80 mol % to 100 mol %.

Examples of the acid monomer components such as divalent or higher carboxylic acids, divalent or higher carboxylic acid anhydrides, and divalent or higher carboxylic acid esters include the following:

Aromatic dicarboxylic acids such as phthalic acid, isophthalic acid and terephthalic acid, and anhydrides thereof:

alkyldicarboxylic acids such as succinic acid, adipic acid, sebacic acid and azelaic acid, and anhydrides thereof; succinic acids substituted with C6-18 alkyl or alkenyl groups, and anhydrides thereof; and unsaturated dicarboxylic acids such as fumaric acid, maleic acid and citraconic acid, and anhydrides thereof.

Preferred among the foregoing are polyvalent carboxylic acids such as terephthalic acid, succinic acid, adipic acid, fumaric acid, trimellitic acid, pyromellitic acid, and benzophenonetetracarboxylic acid, and anhydrides thereof.

The acid value of the polyester resin is preferably 20 mg KOH/g or less, from the viewpoint of colorant dispersibility and stability of triboelectric charge quantity.

The acid value can be kept within this range by adjusting the types and compounding amounts of the monomers used in the resin. Specifically, the acid value can be controlled by adjusting the ratios of alcohol monomer and acid monomers when producing the resin, and adjusting the molecular weight of the resin. The acid value can also be controlled by causing terminal alcohols to react with a polyvalent acid monomer (for instance trimellitic acid), after ester condensation polymerization.

The toner particle may contain a colorant. Examples of colorants include the following.

Examples of black colorants include carbon black, and colorants color-matched to black by using yellow, magenta and/or cyan colorants. A pigment may be used singly as the colorant, but from the viewpoint of image quality with full-color images, it is preferable to use a dye and a pigment concomitantly, to improve color sharpness.

Examples of magenta coloring pigments include the following:

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

Examples of magenta coloring dyes include the following:

oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1; as well as basic dyes such as C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28.

Examples of cyan coloring pigments include the following:

C.I. Pigment Blue 2, 3, 15:2, 15:3, 15:4, 16 and 17; C.I. Vat Blue 6; C.I. Acid Blue 45; and copper phthalocyanine pigments having 1 to 5 phthalimidomethyl groups substituted on a phthalocyanine skeleton.

Examples of cyan coloring dyes include C.I. Solvent Blue 70.

Examples of yellow coloring pigments include the following.

C.I. Pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3 and 20.

Examples of yellow coloring dyes include C.I. Solvent Yellow 162.

The content of the colorant is preferably from 0.1 parts by mass to 30 parts by mass with respect to 100 parts by mass of the binder resin.

The toner particle may contain a wax. Examples of the wax include the following:

hydrocarbon waxes such as low-molecular-weight polyethylene, low-molecular-weight polypropylene, alkylene copolymers, microcrystalline wax, paraffin wax, and Fischer-Tropsch waxes; hydrocarbon wax oxides such as polyethylene oxide wax and block copolymers of these; waxes having fatty acid esters as main components, such as carnauba wax; and partially or fully deoxidized fatty acid esters, such as deoxidized carnauba wax.

Other examples include the following: saturated linear fatty acids such as palmitic acid, stearic acid, and montanic acid; unsaturated fatty acids such as brassidic acid, eleostearic acid and parinaric acid; saturated alcohols such as stearyl alcohol, aralkyl alcohols, behenyl alcohol, carnaubyl alcohol, seryl alcohol, and melissyl alcohol; polyhydric alcohols such as sorbitol; esters of fatty acids such as palmitic acid, stearic acid, behenic acid, and montanic acid with alcohols such as stearyl alcohol, aralkyl alcohols, behenyl alcohol, carnaubyl alcohol, seryl alcohol, and mellisyl alcohol; fatty acid amides such as linoleamide, oleamide, and lauramide; saturated fatty acid bisamides such as methylenebis stearamide, ethylenebis capramide, ethylenebis lauramide, and hexamethylenebis stearamide; unsaturated fatty acid amides such as ethylenebis oleamide, hexamethylenebis oleamide, N,N'-dioleyladipamide and N,N'-dioleylsebacamide; aromatic bisamides such as m-xylenebis stearamide and N,N'-distearylisophthalamide; aliphatic metal salts (commonly called metal soaps) such as calcium stearate, calcium laurate, zinc stearate, and magnesium stearate; aliphatic hydrocarbon waxes grafted with vinylic monomers such as styrene or acrylic acid; partially esterified products of fatty acids and polyhydric alcohols such as behenic acid monoglyceride; and methyl ester compounds having hydroxyl groups and obtained by hydrogenation of plant-based oils and fats.

Preferred among the foregoing are a hydrocarbon wax such as paraffin wax or Fischer-Tropsch wax, or a fatty acid ester wax such as carnauba wax, in terms of improving low-temperature fixability and hot offset resistance.

The content of the wax is preferably from 1.0 part by mass to 15 parts by mass with respect to 100 parts by mass of the binder resin.

From the viewpoint of achieving both storability and hot offset resistance in the toner, the peak temperature of a maximum endothermic peak present in the range of from 30° C. to 200° C., in an endothermic curve obtained upon a rise in temperature by differential scanning calorimetry (DSC) of the wax, is preferably from 50° C. to 110° C.

A resin having both polar segments resembling the wax components and segments resembling the resin polarity may also be added as a wax dispersant, in order to increase the dispersibility of the wax in the binder resin. Specifically, a styrene acrylic resin graft-modified with a hydrocarbon compound is preferred herein.

A charge retention property of the toner is improved if the resin segment of the wax dispersant has a cyclic hydrocarbon group or an aromatic ring introduced therein. This is preferable since impairment of a charging assistance property of the aggregated particles in the toner particle can be suppressed as a result.

The toner particle may contain a charge control agent. Known charge control agents can be used herein, but particularly preferred are metal compounds of aromatic carboxylic acids, which are colorless, afford high toner charging speed, and are capable of holding stably a constant charge quantity.

Examples of negative-type charge control agents include: salicylic acid metal compounds, naphthoic acid metal compounds, dicarboxylic acid metal compounds, polymeric compounds having sulfonic acids or carboxylic acids in side chains, polymeric compounds having sulfonic acid salts or sulfonic acid esters in side chains, polymeric compounds having carboxylic acid salts or carboxylic acid esters in side chains, as well as boron compounds, urea compounds, silicon compounds and calixarenes.

Examples of positive-type charge control agents include quaternary ammonium salts, polymeric compounds having quaternary ammonium salts in side chains, as well as guanidine compounds and imidazole compounds.

The charge control agent may be added either internally or externally to a toner particle. The content of the charge control agent is preferably from 0.2 parts by mass to 10 parts by mass with respect to 100 parts by mass of the binder resin.

The toner can be used as a one-component developer, but may also be mixed with a magnetic carrier and used as a two-component developer, in order to further improve dot reproducibility. A two-component developer is preferred in terms of achieving a stable image over long periods of time.

Examples of magnetic carriers that can be used include the known magnetic carriers below.

Iron oxide; metal particles of iron, lithium, calcium, magnesium, nickel, copper, zinc, cobalt, manganese, chromium and rare earths, as well as alloy particles and oxide particles of the foregoing; magnetic bodies such as ferrite; and magnetic body-dispersed resin carriers (so-called resin carriers) containing a magnetic body and a binder resin that holds the magnetic body in a dispersed state.

In a case of using a two-component developer resulting from mixing a toner with a magnetic carrier, the mixing ratio of the magnetic carrier is preferably from 2 mass % to 15 mass %, and more preferably from 4 mass % to 13 mass %, as the toner concentration in the two-component developer.

The method for producing the toner particle is not particularly limited and may be any known method such as emulsion aggregation, melt kneading or dissolution suspension. Melt kneading is preferred herein in terms of enhancing the dispersibility of starting materials.

In a melt kneading method, a toner composition being the material of the toner particle is melt kneaded, and the obtained kneaded product is then pulverized. Examples of production methods will be explained next.

In a raw material mixing step, the materials constituting the toner particle, namely the binder resin as well as other components such as a colorant, a wax and a charge control agent, as needed, are weighed in predetermined amounts, and are compounded and mixed. The mixing apparatus may be for instance a double-cone mixer, a V-shaped mixer, a drum mixer, a super mixer, a Henschel mixer, Nauta mixer or Mechano Hybrid (Nippon Coke & Engineering Co., Ltd.).

Next, the mixed materials are melt-kneaded to disperse for instance other starting materials in the binder resin. A batch kneader such as a pressure kneader or Banbury mixer, or a continuous kneader, may be used in this melt kneading step; generally a single- or twin-screw extruder is used given the superiority of the foregoing in terms of enabling continuous production. Specific examples include KTK twin-screw extruder (by Kobe Steel, Ltd.), TEM twin-screw extruder (by Toshiba Machine Co., Ltd.), PCM kneader (by Ikegai Corp.), twin-screw extruder (by KCK), Ko-kneader (by Buss AG) and Kneadex (by Nippon Coke & Engineering Co., Ltd.). The resin composition obtained by melt kneading may then be rolled using for instance two rolls, and may be cooled for instance with water in a cooling step.

Next, the cooled resin composition is pulverized to the desired particle diameter in a pulverization step. In the pulverization step, the material is first coarsely pulverized using a crushing apparatus such as a crusher, hammer mill or feather mill, and then finely pulverized using a pulverizer. Examples of pulverizers include Krypton system (by Kawasaki Heavy Industries, Ltd.), Super Rotor (by Nisshin Engineering Inc.) and Turbo Mill (by Freund-Turbo Corporation), and pulverizers using air jet systems.

This is followed as needed by classification using a sieving or classifying apparatus such as Elbow Jet (Nittetsu Mining Co., Ltd.) relying on inertial classification, or Turboplex (Hosokawa Micron Corporation), TSP Separator (Hosokawa Micron Corporation) or Faculty (Hosokawa Micron Corporation) relying on centrifugal classification, to obtain a toner particle.

A weight-average diameter from 4.0 μm to 8.0 μm of the toner particle is preferable herein since in that case the effect of the inorganic fine particles can be sufficiently brought out. The circularity of the toner particle may also be increased by exerting a mechanical impact force on the toner particle, or by performing a heating treatment by hot air or the like. The average circularity of the toner particle is preferably from about 0.962 to about 0.972 in order to maximize charge transfer opportunities and frictional forces between toner particles, and to increase the speed of rise-up of charging.

The inorganic fine particles may be added, and externally mixed, with the toner particle.

The mixing apparatus may be for example a double-cone mixer, a V-shaped mixer, a drum mixer, a super mixer, a Henschel mixer, Nauta mixer or Mechano Hybrid (Nippon Coke & Engineering Co., Ltd.).

Methods for measuring various physical properties of the toner and starting materials will be explained below.

<Method for Measuring Number-Average Particle Diameter of Primary Particles of Metal Salt, Aggregation Diameter of Aggregated Particles, and Coverage Ratio of Aggregated Particles with Respect to Toner Particle Surface>

The number-average particle diameter of the metal salt and so forth, the aggregation diameter of the aggregated particles and the coverage ratio of the aggregated particles with respect to the toner particle surface can be calculated from backscattered electron images captured using Hitachi Ultra-high Resolution Field Emission Scanning Electron Microscope S-4800 (Hitachi High-Technologies Corporation). The imaging conditions of S-4800 are as follows.

(1) Sample Preparation

A conductive paste is thinly coated on a sample stand (15 mm×6 mm aluminum sample stand), and particles are blown onto the paste. Air is then blown to remove excess particles from the sample stand, and thoroughly dry the particles. The sample stand is set in a sample holder, and the height of the sample stand is adjusted to 36 mm using a sample height gauge.

(2) Setting of S-4800 Observation Conditions

Liquid nitrogen is poured into an anti-contamination trap attached to the housing of S-4800, until overflow, and the whole is allowed to stand for 30 minutes. Then "PC-SEM" of S-4800 is started to perform flushing (purification of a FE chip as an electron source). The acceleration voltage display portion of the control panel on the image is clicked, and the [Flushing] button is pressed to open a flushing execution dialog. Flushing is executed after the flushing strength is confirmed to be 2. It is then checked that the emission current from flushing is from 20 μA to 40 μA. The sample holder is inserted into the sample chamber of the S-4800 housing. Then [Origin] is pressed on the control panel, to transfer the sample holder to the observation position.

The acceleration voltage display portion is clicked to open an HV setting dialog, and acceleration voltage is set to [1.1 kV] and emission current to [20 μA]. In a [Basic] tab of the operation panel, signal selection is set to [SE], [Upper (U)] and [+BSE] are selected as the SE detector, and [L.A. 100] is selected using the selection button to the right of [+BSE], to set a mode of observation on a backscattered electron image. In the same [Basic] tab of the operation panel, the probe current of a condition block of the electronic optical system is set to [Normal], focus mode to [UHR], and WD to [4.5 mm]. The [ON] button of the acceleration voltage display portion on the control panel is pressed, to apply acceleration voltage.

(3) Focus Adjustment

The [COARSE] focus knob on the operation panel is turned, and the aperture alignment is adjusted once a certain focus is achieved. Then [Align] is clicked on the control panel to display an alignment dialog, and [Beam] is selected. The STIGMA/ALIGNMENT knobs (X, Y) on the operation panel are turned, and the displayed beam is moved to the center of the concentric circle. Then [Aperture] is selected, and the STIGMA/ALIGNMENT knobs (X, Y) are turned one at a time until image movement stops or is minimized. The aperture dialog is closed, and focusing is performed using autofocus. The magnification is then set to 80,000× (80 k), the focus is adjusted with the focus knob and STIGMA/ALIGNMENT knobs as described above, and focusing is performed once more using autofocus. This operation is repeated again to adjust focus. When the inclination angle of an observation surface is large, the measurement precision of coverage ratio is prone to decrease. To perform the analysis, therefore, an observation surface exhibiting as little tilt as possible is selected by choosing the observation surface so that the entirety thereof becomes focused simultaneously.

(4) Image Storage

Brightness is adjusted in an ABC mode, and 640×480 pixel photographs are captured and stored. The below-described analysis is performed using these image files. Multiple photographs are taken to obtain enough images so that at least 500 particles can be analyzed.

(5) Image Analysis

The particle diameters of 500 particles (aggregated particles in the case of aggregation diameter) are measured, and the number-average particle diameter is determined as the arithmetic mean value of the measurements. The major axis diameter is measured herein as the particle diameter. In the present invention, number-average particle diameters are calculated through binarization of images using the image analysis software Image-Pro Plus ver. 5.0.

The particle diameter of inorganic fine particles on the toner particle surface can also be measured in accordance with a similar method. To measure the particle diameter of inorganic fine particles on the toner particle surface, the particles to be measured may be first identified beforehand on the toner particle surface, by elemental analysis using for instance an energy dispersive X-ray analyzer (EDAX).

The coverage ratio of the aggregated particles with respect to the toner particle surface is calculated in accordance with the method below.

Rectangular areas resulting from dividing into nine areas a circumscribed rectangle of one toner particle, the long side of the rectangle being the major axis of the toner particle, are analyzed to work out a coverage ratio derived from the aggregated particles.

In a case where a background that is not a toner particle surface is depicted on the image of the nine divided rectangular areas, only the surface portion of the toner particle is set as an AOI (area of interest), and thereafter the following analysis is carried out. The AOI can be defined by selecting a free-form AOI button from the AOI tool, and drawing a closed curve so as to trace the outline of the surface portion of the toner particle.

In a tool bar, "Measure" and "Count/Size" are selected in this order, and "Automatic Bright Objects" is selected in the column "Intensity Range Selection". Further, 8-Connect is selected among the object extraction options, and Smoothing is set to 0. In addition, Pre-Filter, Fill Holes, and Convex Hull are not selected, and "Clean Borders" is set to "None". In the tool bar, "Select Measurements" is selected from "Measure", and Filter Ranges of Area is set to the range of from 2 to $1\times10^7$. Then "Count" is pressed, to extract external additive particle components.

Next, from among the extracted external additive particle components, those particles being a dense aggregation of three or more particles are visually extracted as aggregated particles. In a case where aggregated particles are present that have a boundary including gaps between aggregated particles, the aggregated particles having that boundary are taken as aggregated particles that can be viewed as connected on the image, and are subjected beforehand to the following splitting operation. Specifically, "Measure" and "Count/Size" are selected in this order, and the Split Objects command is selected. If "Auto" in a Trace Dialog Box had been ticked, that checkmark is unticked. A dividing line is drawn along the connection boundaries of connected particles, and the OK button in the Split Dialog box is pressed, to complete the split. Then "Exclude" is selected in an object attribute window, for the object number of each particle that is not to be analyzed, on the image. This operation is repeated to extract only particles that are to be analyzed.

The coverage ratio is worked out, in accordance with the expression below, on the basis of a total sum (P) of areas of extracted target aggregated particle components, and the surface area (S) of the toner particle surface set as an AOI, from within the above-described nine divisional rectangular areas.

$$\text{Coverage ratio (area \%)}=(P/S)\times 100$$

An average value and standard deviation are worked out from the coverage ratio of the nine divisional rectangular areas, and the resulting average value is taken as the coverage ratio of the toner particle.

The same operation is repeated for 100 toner particles, to work out an average value of the coverage ratio, which is then taken as the coverage ratio of the aggregated particles with respect to the toner particle surface.

The volume resistivity of the aggregated particles is measured as follows.

Herein a Keithley Instruments 6517-model electrometer/high-resistance system is used as the device. Electrodes having a diameter of 25 mm are connected, the aggregated particles are laid to a thickness of about 0.5 mm, and a load of about 2.0 N is applied; the distance across the electrodes is measured in that state.

A resistance value upon application of voltage (1000 V) across the aggregated particles for 1 minute is measured, and volume resistivity is calculated on the basis of the expression below.

$$\text{Volume resistivity } (\Omega\cdot cm)=R\times L$$

R: resistance value (s))

L: distance between electrodes (cm)

The average circularity of the aggregated particles is measured as follows.

A magnified image of the aggregated particles captured using the above electron microscope is loaded into a computer, the circumference of a circle having the same surface area as a particle projection area and the perimeter of a particle projected image are calculated using the software "analySIS" by Soft Imaging System Inc., and circularity is calculated on the basis of the expression below.

Circularity=(circumference of circle having the same surface area as particle projection area)/(perimeter of particle projected image)

The target data used herein is randomly extracted from among 100 samples of aggregated particle images obtained from the images; the arithmetic mean value of the circularities of the 100 samples is taken as the average circularity.

<Method for Measuring Weight-Average Particle Diameter (D4) of Toner (Particle)>

The weight-average particle diameter (D4) of the toner (particle) is calculated by analyzing measurement data resulting from a measurement, in 25,000 effective measurement channels, using a precision particle diameter distribution measurement apparatus "Coulter Counter Multisizer 3" (registered trademark, by Beckman Coulter, Inc.) relying on a pore electrical resistance method and equipped with a 100 μm aperture tube, and by using dedicated software "Beckman Coulter Multisizer 3, Version 3.51" (by Beckman Coulter, Inc.) ancillary to the apparatus, for setting measurement conditions and analyzing measurement data.

The aqueous electrolyte solution used in the measurements can be prepared through dissolution of special-grade sodium chloride at a concentration of about 1 mass % in ion-exchanged water; for instance "ISOTON II" (by Beckman Coulter, Inc.) can be used herein.

The dedicated software is set up as follows prior to measurement and analysis.

In the "Changing Standard Operating Mode (SOM)" screen of the dedicated software, a total count of the control mode is set to 50,000 particles, a number of runs is set to one, and a Kd value is set to a value obtained using "Standard particles 10.0 μm" (by Beckman Coulter, Inc.). The threshold/noise level measuring button is pressed to thereby automatically set a threshold value and a noise level. Then the current is set to 1600 μA, the gain is set to 2, the electrolyte solution is set to ISOTON II, and flushing of the aperture tube following measurement is ticked.

In the "setting conversion from pulses to particle size" screen of the dedicated software, the bin interval is set to a logarithmic particle diameter, the particle diameter bin is set to 256 particle diameter bins, and the particle diameter range is set to range from 2 μm to 60 μm.

Specific measurement methods are as described below.

(1) Herein 200 mL of the aqueous electrolyte solution is placed in a 250 mL round-bottomed glass beaker ancillary to Multisizer 3. The beaker is set on a sample stand and is stirred counterclockwise with a stirrer rod at 24 rotations per second. Debris and air bubbles are then removed from the aperture tube by the "aperture tube flush" function of the dedicated software.

(2) Then about 30 mL of the aqueous electrolyte solution is placed in a 100 mL flat-bottomed glass beaker, and about 0.3 mL of a dilution is added thereto as a dispersant.

The dilution contains a dispersant "Contaminon N" (10 mass % aqueous solution of a pH 7 neutral detergent for cleaning of precision instruments, comprising a nonionic surfactant, an anionic surfactant and an organic builder, by Wako Pure Chemical Industries, Ltd.) diluted thrice by mass in ion-exchanged water.

(3) A predetermined amount of ion-exchanged water is placed in a water tank of an ultrasonic disperser having an electrical output of 120 W and internally equipped with two oscillators that oscillate at a frequency of 50 kHz and are disposed at a phase offset of 180 degrees, and about 2 mL of the above Contaminon N are added into the water tank.

The ultrasonic disperser that is used is "Ultrasonic Dispersion System Tetora 150" (by Nikkaki Bios Co., Ltd.).

(4) The beaker of (2) is set in a beaker-securing hole of the ultrasonic disperser, which is then operated. The height position of the beaker is adjusted so as to maximize a resonance state at the liquid level of the aqueous electrolyte solution in the beaker.

(5) With the aqueous electrolyte solution in the beaker of (4) being ultrasonically irradiated, about 10 mg of the toner (particle) are added little by little to the aqueous electrolyte solution, to be dispersed therein. The ultrasonic dispersion treatment is further continued for 60 seconds. The water temperature of the water tank at the time of ultrasonic dispersion is adjusted as appropriate to lie in the range of from 15° C. to 40° C.

(6) The aqueous electrolyte solution of (5) containing the dispersed toner (particle) is added dropwise, using a pipette, to the round-bottomed beaker of (1) set on the sample stand, to adjust the measurement concentration to about 5%. A measurement is then performed until the number of measured particles reaches 50,000.

(7) Measurement data is analyzed using the dedicated software ancillary to the apparatus, to calculate the weight-average particle diameter (D4). The "average size" in the analysis/volume statistics (arithmetic average) screen, when graph/% by volume is selected in the dedicated software, yields herein the weight-average particle diameter (D4).

<Method for Measuring Average Circularity of Toner>

The average circularity of the toner is measured using a flow particle image analyzer "FPIA-3000" (by Sysmex Corporation) under measurement and analysis conditions of a calibration process. The concrete measurement method is as follows.

Firstly, about 20 mL of ion-exchanged water having solid impurities and so forth removed therefrom beforehand are placed in a glass vessel. Then about 0.2 mL of a dilution containing a dispersant in the form of "Contaminon N" (10 mass % aqueous solution of a pH 7 neutral detergent for cleaning of precision instruments, containing a nonionic surfactant, an anionic surfactant and an organic builder, produced by Wako Pure Chemical Industries, Ltd.) diluted about three times by mass in ion-exchanged water, is added into the glass vessel. Further, about 0.02 g of the measurement sample are added and are dispersed for 2 minutes using an ultrasonic disperser, to prepare a dispersion for measurement. The dispersion is cooled as appropriate down to a temperature of from 10° C. to 40° C. The ultrasonic disperser used herein is a desktop ultrasonic cleaner/disperser ("VS-150" by Velvo-Clear Co.) having an oscillation frequency of 50 kHz and an electrical output of 150 W. A given amount of ion-exchanged water is placed in the water tank, and about 2 mL of the above Contaminon N are added into the water tank.

The above flow particle image analyzer equipped with a standard objective lens (10 magnifications) is used in the measurement. A sheath solution utilized herein is a particle sheath "PSE-900A" (by Sysmex Corporation).

The dispersion prepared according to the above procedure is introduced to the flow particle image analyzer, and 3000 toner particles are measured according to a total count mode in an HPF measurement mode. The average circularity of the aggregated particles is then worked out with a binarization threshold at the time of particle analysis set to 85%, and with analyzed particle diameter limited to a circle-equivalent diameter of 1.985 μm or larger and smaller than 39.69 μm.

In the measurement, automatic focus adjustment is performed before the start of the measurement, using standard latex particles (dilution of "RESEARCH AND TEST PARTICLES Latex Microsphere Suspensions 5200A", by Duke Scientific Corporation, in ion-exchanged water). Thereafter, focus is preferably adjusted every 2 hours from the start of the measurement.

In the examples of the present application, a flow particle image analyzer calibrated by Sysmex Corporation and having been issued with a calibration certificate by Sysmex Corporation is used. The measurement is performed under the same measurement and analysis conditions as those at the time of issuance of the calibration certification, except that the analyzed particle diameter is limited to a circle-equivalent diameter of 1.985 μm or larger and smaller than 39.69 μm.

EXAMPLES

The present invention will be explained below by way of production examples and examples, but the present invention is not meant to be limited thereto in any way. Unless otherwise stated, the language "parts" in the formulations below refers to parts by mass in all instances.

<Production Example of Aggregated Particles 1>

Metatitanic acid obtained in accordance with a sulfuric acid method was subjected to an iron-removal bleaching treatment, and thereafter pH was adjusted to 9.0 through addition of a sodium hydroxide aqueous solution, to perform desulfurization.

The product was subsequently neutralized to pH 5.8 with hydrochloric acid, and was filtered and washed with water. Water was added to the washed cake to obtain a slurry containing 1.5 mol/L of $TiO_2$, after which hydrochloric acid was added to bring the pH down to 1.5, to perform a deflocculation treatment.

The desulfurized and deflocculated metatitanic acid was collected as $TiO_2$, and was charged into a 3 L reaction vessel.

A strontium chloride aqueous solution was added to this deflocculated metatitanic acid slurry, to a $SrO/TiO_2$ molar ratio of 1.15, after which the $TiO_2$ concentration was adjusted to 0.8 mol/L.

The resulting mixture was followed by heating to 90° C. while under stirring and mixing, after which 444 mL of a 10 mol/L aqueous solution of sodium hydroxide was added over 50 minutes, while under micro-bubbling of 600 mL/min of nitrogen gas. Thereafter the whole was stirred for 1 hour at 95° C. while under micro-bubbling with 400 mL/min of nitrogen gas.

The obtained reaction slurry was subsequently cooled rapidly down to 15° C., with stirring, while under flow of 10° C. cooling water through a jacket of the reaction vessel; hydrochloric acid was then added, until pH was 2.0, and stirring was continued for 1 hour. The obtained precipitate was washed by decantation, and thereafter 6 mol/L hydrochloric acid were added thereto, to adjust the pH to 2.0, and 4.6 parts of isobutyltrimethoxysilane and 4.6 parts of trimethoxy(3,3,3-trifluoropropyl)silane were added with respect to 100 parts of solids, with stirring for 18 hours. The resulting product was neutralized with a 4 mol/L sodium hydroxide aqueous solution, was stirred for 2 hours, and was then filtered and separated, with drying for 8 hours in the atmosphere at 120° C., to yield Aggregated particles 1.

The obtained Aggregated particles 1 exhibited diffraction peaks of strontium titanate in an X-ray diffraction measurement.

The number-average particle diameter of the primary particles of strontium titanate that made up Aggregated particles 1 was 30 nm, the aggregation diameter of Aggregated particles 1 was 120 nm, and the volume resistivity of Aggregated particles 1 was $2\times10^{10}$ Ω·cm. Table 1-1 sets out the physical properties of Aggregated particles 1.

<Production Examples of Aggregated Particles 2 to 30>

Aggregated particles 2 to 30 were obtained in the same way as in Aggregated particles 1, but herein the composition and types of Additive 1 and Additive 2 were modified as given in Table 1-1 to Table 1-4, and for instance the amount of Additive 1, the time of addition of sodium hydroxide, and the nitrogen micro-bubbling flow rate were modified so as to achieve the physical properties given in Table 1-1 to Table 1-4. The physical properties of Aggregated particles 2 to 30 are set out in Table 1-1 to Table 1-4.

Abbreviations utilized in the tables are as follows.

A1: strontium titanate
A2: calcium titanate
A3: magnesium titanate
A4: strontium zirconate A5: calcium zirconate
A6: magnesium zirconate
B1: isobutyltrimethoxysilane
B2: octyltrimethoxysilane
B3: sodium stearate
B4: silicone oil (dimethyl polysiloxane, dynamic viscosity 200 $mm^2/s$)
C1: trimethoxy(3,3,3-trifluoropropyl)silane

TABLE 1-1

| | Aggregated particle No. | | | | | | | |
|---|---|---|---|---|---|---|---|---|
| | 1 | 2 | 3 | 4 | 5 | 6 | 7 | 8 |
| Number-average particle diameter (nm) of primary particles | 30 | 20 | 45 | 20 | 45 | 20 | 20 | 20 |
| Aggregation diameter (nm) of aggregated particles | 120 | 130 | 100 | 150 | 95 | 150 | 150 | 150 |
| Volume resistivity (Ω · cm) | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ |
| Composition | A1 | A1 | A1 | A1 | A1 | A1 | A1 | A1 |
| Additive 1 | B1 | B1 | B1 | B1 | B1 | B1 | B1 | B1 |
| Additive 2 | C1 | C1 | C1 | C1 | C1 | C1 | C1 | C1 |
| Average circularity of aggregated particles | 0.850 | 0.870 | 0.820 | 0.880 | 0.820 | 0.910 | 0.780 | 0.920 |

TABLE 1-2

| | Aggregated particle No. | | | | | | | |
|---|---|---|---|---|---|---|---|---|
| | 9 | 10 | 11 | 12 | 13 | 14 | 15 | 16 |
| Number-average particle diameter (nm) of primary particles | 20 | 20 | 20 | 20 | 20 | 20 | 20 | 30 |
| Aggregation diameter (nm) of aggregated particles | 150 | 150 | 150 | 150 | 150 | 150 | 150 | 80 |
| Volume resistivity (Ω · cm) | $2 \times 10^{10}$ | $2 \times 10^{10}$ | $2 \times 10^{10}$ | $1 \times 10^{10}$ | $1 \times 10^{12}$ | $2 \times 10^{9}$ | $2 \times 10^{13}$ | $2 \times 10^{10}$ |
| Composition | A1 | A1 | A1 | A1 | A1 | A1 | A1 | A1 |
| Additive 1 | B1 | B1 | B2 | B3 | B4 | B4 | B4 | B4 |
| Additive 2 | C1 | — | — | — | — | — | — | — |
| Average circularity of aggregated particles | 0.760 | 0.920 | 0.920 | 0.920 | 0.920 | 0.920 | 0.920 | 0.770 |

TABLE 1-3

| | Aggregated particle No. | | | | | | | |
|---|---|---|---|---|---|---|---|---|
| | 17 | 18 | 19 | 20 | 21 | 22 | 23 | 24 |
| Number-average particle diameter (nm) of primary particles | 30 | 15 | 55 | 30 | 30 | 30 | 30 | 30 |
| Aggregation diameter (nm) of aggregated particles | 300 | 120 | 120 | 120 | 120 | 120 | 120 | 120 |
| Volume resistivity (Ω · cm) | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ |
| Composition | A1 | A1 | A1 | A2 | A3 | A4 | A5 | A6 |
| Additive 1 | B4 | B4 | B4 | B4 | B4 | B4 | B4 | B4 |
| Additive 2 | — | — | — | — | — | — | — | — |
| Average circularity of aggregated particles | 0.930 | 0.920 | 0.760 | 0.920 | 0.920 | 0.920 | 0.920 | 0.920 |

TABLE 1-4

| | Aggregated particle No. | | | | | |
|---|---|---|---|---|---|---|
| | 25 | 26 | 27 | 28 | 29 | 30 |
| Number-average particle diameter (nm) of primary particles | 10 | 60 | 30 | 30 | 30 | 30 |
| Aggregation diameter (nm) of aggregated particles | 120 | 130 | 70 | 400 | 120 | 120 |
| Volume resistivity (Ω · cm) | $2 \times 10^{10}$ | $2 \times 10^{10}$ | $2 \times 10^{10}$ | $2 \times 10^{10}$ | $2 \times 10^{8}$ | $2 \times 10^{14}$ |
| Composition | A1 | A1 | A1 | A1 | A1 | A1 |

TABLE 1-4-continued

| | Aggregated particle No. | | | | | |
|---|---|---|---|---|---|---|
| | 25 | 26 | 27 | 28 | 29 | 30 |
| Additive 1 | B4 | B4 | B4 | B4 | B4 | B4 |
| Additive 2 | — | — | — | — | — | — |
| Average circularity of aggregated particles | 0.930 | 0.740 | 0.750 | 0.930 | 0.850 | 0.850 |

<Production Example of Binder Resin>

(Production Example of Polyester Resin)

Polyoxypropylene (2.2)-2,2-bis(4-hydroxyphenyl)propane: 80.0 mol % relative to the total number of moles of polyhydric alcohols Polyoxyethylene (2.2)-2,2-bis(4-hydroxyphenyl)propane: 20.0 mol % relative to the total number of moles of polyhydric alcohols Terephthalic acid: 80.0 mol % relative to the total number of moles of polyvalent carboxylic acids Trimellitic anhydride: 20.0 mol % relative to the total number of moles of polyvalent carboxylic acids The above materials were charged into a reaction vessel equipped with a condenser, a stirrer, a nitrogen inlet tube and a thermocouple. Then, 1.5 parts of tin 2-ethylhexanoate (esterification catalyst) were added as a catalyst with respect to 100 parts as the total amount of monomers. Next, the interior of the reaction vessel was purged with nitrogen gas, after which the temperature was gradually raised while under stirring; the reaction was conducted for 2.5 hours, while under stirring at a temperature of 200° C.

The pressure inside the reaction vessel was reduced to 8.3 kPa, and was maintained there for 1 hour, after which the reaction vessel was cooled down to 180° C. While the reaction was allowed to proceed as it was, it was checked whether a softening point measured in accordance with the ASTM D36-86 had reached 110° C., after which the temperature was lowered to thereby stop the reaction. The softening point of the obtained polyester resin was 115° C.

<Production Example of Wax Dispersant>

Herein 300.0 parts of xylene and 10.0 parts of polypropylene (melting point 75° C.) were charged in an autoclave reaction vessel equipped with a thermometer and a stirrer, the foregoing were sufficiently dissolved, and then the reaction vessel was purged with nitrogen. Thereafter, a mixed solution of 73.0 parts of styrene, 5.0 parts of cyclohexyl methacrylate, 12.0 parts of butyl acrylate and 250.0 parts of xylene were added dropwise at 180° C. over 3 hours, to elicit polymerization. The temperature was held for a further 30 minutes, to remove the solvent and yield a wax dispersant.

<Production Example of Toner 1>

| | |
|---|---|
| Polyester resin | 100.0 parts |
| Aluminum 3,5-di-t-butyl salicylate compound | 0.1 parts |
| Fischer Tropsch wax (melting point: 90° C.) | 5.0 parts |
| Wax dispersant | 6.5 parts |
| C.I. Pigment blue 15:3 | 5.0 parts |

The starting materials in the above formulation were mixed using a Henschel Mixer (FM75J, by Mitsui Miike Chemical Engineering Machinery, Co., Ltd.) at a rotational speed of 20 $s^{-1}$ for a rotation time of 5 min, followed by kneading using a twin-screw kneading extruder (Model PCM-30, by Ikegai Corp.) set to a temperature of 130° C. and to a barrel rotational speed of 200 rpm. The obtained kneaded product was cooled, and was coarsely pulverized using a hammer mill to 1 mm or less, to yield a coarsely pulverized product. The obtained coarsely pulverized product was finely pulverized using a mechanical pulverizer (T-250, by Turbo Kogyo Co., Ltd.). The resulting product was then classified using a rotary classifier (200 TSP, by Hosokawa Micron Corporation), to obtain Toner particle 1. As the operating conditions of the rotary classifier (200 TSP, Hosokawa Micron Corporation), the rotational speed of a classifying rotor was set to 50.0 The obtained Toner particle 1 had a weight-average particle diameter (D4) of 5.7 μm.

To 100.0 parts of Toner particle 1, the followings were added:

5.0 parts of silica fine particles having a number-average particle diameter of 120 nm as primary particles; and 0.2 parts of hydrophobic silica fine particles having a number-average particle diameter of 10 nm as primary particles and having undergone a surface treatment with 10.0 mass % of hexamethyldisilazane.

The foregoing were mixed using a Henschel mixer (FM75J, by Mitsui Miike Chemical Engineering Machinery, Co., Ltd.) at a rotational speed of 15 $s^{-1}$, for a rotation time of 10 min, and at a jacket temperature of 45° C.

Thereafter, 0.5 parts of Aggregated particles 1 and 0.8 parts of hydrophobic silica fine particles having an number-average particle diameter of 10 nm as primary particles and having undergone a surface treatment with 10.0 mass % of hexamethyl disilazane, were further added, after which the whole was mixed at a rotational speed of 30 $s^{-1}$, for a rotation time of 4 min and at a jacket temperature of 20° C., followed by passing through an ultrasonic vibrating sieve having a mesh opening of 54 μm, to yield Toner 1 having an average circularity of 0.970.

The coverage ratio of the aggregated particles with respect to the toner particle surface of Toner 1 was 1.0 area %, the aggregation diameter of the aggregated particles was 120 nm, and the volume resistivity of the aggregated particles was $2\times10^{10}$ Ω·cm.

The average circularity of the aggregated particles was 0.850, and a ratio (α/β) of the number-average particle diameter (α) of the primary particles of a metal salt with respect to the aggregation diameter (β) of the aggregated particles was 0.25. The physical properties of Toner 1 are set out in Table 2-1.

<Production Examples of Toners 2 to 34>

Toners 2 to 34 were obtained in the same way as in production example of Toner 1, but herein Aggregated particles 1 that were used were modified as given in Table 2-1 to Table 2-5. The physical properties of the obtained Toners 2 to 34 are given in Table 2-1 to Table 2-5.

TABLE 2-1

| | Toner No. | | | | | | | |
|---|---|---|---|---|---|---|---|---|
| | 1 | 2 | 3 | 4 | 5 | 6 | 7 | 8 |
| Toner particle (D4: μm) | 5.7 | 5.7 | 5.7 | 5.7 | 5.7 | 5.7 | 5.7 | 5.7 |
| Average circularity | 0.970 | 0.970 | 0.970 | 0.970 | 0.970 | 0.970 | 0.970 | 0.970 |
| Aggregated particle No. | 1 | 2 | 3 | 4 | 5 | 6 | 7 | 8 |
| Addition amount (parts) of aggregated particles | 0.50 | 1.10 | 0.35 | 0.65 | 0.40 | 0.65 | 0.65 | 0.65 |
| Number-average particle diameter (nm) of primary particles | 30 | 20 | 45 | 20 | 45 | 20 | 20 | 20 |
| Aggregation diameter (nm) of aggregated particles | 120 | 130 | 100 | 150 | 95 | 150 | 150 | 150 |
| Volume resistivity (Ω · cm) | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ |
| Coverage ratio (area %) | 1.0 | 2.0 | 0.8 | 1.0 | 1.0 | 1.0 | 1.0 | 1.0 |
| Average circularity of aggregated particles | 0.850 | 0.870 | 0.820 | 0.880 | 0.820 | 0.910 | 0.780 | 0.920 |
| (α/β) | 0.25 | 0.15 | 0.45 | 0.13 | 0.47 | 0.13 | 0.13 | 0.13 |

TABLE 2-2

| | Toner No. | | | | | | | |
|---|---|---|---|---|---|---|---|---|
| | 9 | 10 | 11 | 12 | 13 | 14 | 15 | 16 |
| Toner particle (D4: μm) | 5.7 | 5.7 | 5.7 | 5.7 | 5.7 | 5.7 | 5.7 | 5.7 |
| Average circularity | 0.970 | 0.970 | 0.970 | 0.970 | 0.970 | 0.970 | 0.970 | 0.970 |
| Aggregated particle No. | 9 | 10 | 11 | 12 | 13 | 13 | 13 | 14 |
| Addition amount (parts) of aggregated particles | 0.65 | 0.65 | 0.65 | 0.65 | 0.65 | 0.20 | 5.00 | 0.50 |
| Number-average particle diameter (nm) of primary particles | 20 | 20 | 20 | 20 | 20 | 20 | 20 | 20 |
| Aggregation diameter (nm) of aggregated particles | 150 | 150 | 150 | 150 | 150 | 150 | 150 | 150 |
| Volume resistivity (Ω · cm) | $2 \times 10^{10}$ | $2 \times 10^{10}$ | $2 \times 10^{10}$ | $1 \times 10^{10}$ | $1 \times 10^{12}$ | $2 \times 10^{10}$ | $2 \times 10^{10}$ | $2 \times 10^{9}$ |
| Coverage ratio (area %) | 1.0 | 1.0 | 1.0 | 1.0 | 1.0 | 0.3 | 10.0 | 1.0 |
| Average circularity of aggregated particles | 0.760 | 0.920 | 0.920 | 0.920 | 0.920 | 0.920 | 0.920 | 0.920 |
| (α/β) | 0.13 | 0.13 | 0.13 | 0.13 | 0.13 | 0.13 | 0.13 | 0.13 |

TABLE 2-3

| | Toner No. | | | | | | | |
|---|---|---|---|---|---|---|---|---|
| | 17 | 18 | 19 | 20 | 21 | 22 | 23 | 24 |
| Toner particle (D4: μm) | 5.7 | 5.7 | 5.7 | 5.7 | 5.7 | 5.7 | 5.7 | 5.7 |
| Average circularity | 0.970 | 0.970 | 0.970 | 0.970 | 0.970 | 0.970 | 0.970 | 0.970 |
| Aggregated particle No. | 15 | 16 | 17 | 18 | 19 | 20 | 21 | 22 |
| Addition amount (parts) of aggregated particles | 0.65 | 0.35 | 1.30 | 0.50 | 0.50 | 0.50 | 0.43 | 0.70 |
| Number-average particle diameter (nm) of primary particles | 20 | 30 | 30 | 15 | 55 | 20 | 20 | 20 |
| Aggregation diameter (nm) of aggregated particles | 150 | 80 | 300 | 120 | 120 | 150 | 150 | 150 |
| Volume resistivity (Ω · cm) | $2 \times 10^{13}$ | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{10}$ |
| Coverage ratio (area %) | 1.0 | 1.0 | 1.0 | 6.0 | 0.4 | 1.0 | 1.0 | 1.0 |
| Average circularity of aggregated particles | 0.920 | 0.770 | 0.920 | 0.920 | 0.750 | 0.920 | 0.920 | 0.920 |
| (α/β) | 0.13 | 0.38 | 0.10 | 0.13 | 0.46 | 0.13 | 0.13 | 0.13 |

TABLE 2-4

| | Toner No. | | | | | | | |
|---|---|---|---|---|---|---|---|---|
| | 25 | 26 | 27 | 28 | 29 | 30 | 31 | 32 |
| Toner particle (D4: μm) | 5.7 | 5.7 | 5.7 | 5.7 | 5.7 | 5.7 | 5.7 | 5.7 |
| Average circularity | 0.970 | 0.970 | 0.970 | 0.970 | 0.970 | 0.970 | 0.970 | 0.970 |
| Aggregated particle No. | 23 | 24 | 25 | 26 | 27 | 28 | 29 | 30 |

TABLE 2-4-continued

| | Toner No. | | | | | | | |
|---|---|---|---|---|---|---|---|---|
| | 25 | 26 | 27 | 28 | 29 | 30 | 31 | 32 |
| Addition amount (parts) of aggregated particles | 0.65 | 0.56 | 0.50 | 0.55 | 0.30 | 1.70 | 0.50 | 0.50 |
| Number-average particle diameter (nm) of primary particles | 20 | 20 | 10 | 60 | 30 | 30 | 30 | 30 |
| Aggregation diameter (nm) of aggregated particles | 150 | 150 | 120 | 130 | 70 | 400 | 120 | 120 |
| Volume resistivity (Ω · cm) | $2 \times 10^{10}$ | $2 \times 10^{10}$ | $2 \times 10^{10}$ | $2 \times 10^{10}$ | $2 \times 10^{10}$ | $2 \times 10^{10}$ | $2 \times 10^{8}$ | $2 \times 10^{14}$ |
| Coverage ratio (area %) | 1.0 | 1.0 | 1.0 | 1.0 | 1.0 | 1.0 | 1.0 | 1.0 |
| Average circularity of aggregated particles | 0.920 | 0.920 | 0.920 | 0.750 | 0.750 | 0.920 | 0.850 | 0.850 |
| (α/β) | 0.13 | 0.13 | 0.08 | 0.46 | 0.43 | 0.08 | 0.25 | 0.25 |

TABLE 2-5

| | Toner No. | |
|---|---|---|
| | 33 | 34 |
| Toner particle (D4: μm) | 5.7 | 5.7 |
| Average circularity | 0.970 | 0.970 |
| Aggregated particle No. | 1 | 1 |
| Addition amount (parts) of aggregated particles | 0.10 | 6.00 |
| Number-average particle diameter (nm) of primary particles | 30 | 30 |
| Aggregation diameter (nm) of aggregated particles | 120 | 120 |
| Volume resistivity (Ω · cm) | $2 \times 10^{10}$ | $2 \times 10^{10}$ |
| Coverage ratio (area %) | 0.2 | 12.0 |
| Average circularity of aggregated particles | 0.920 | 0.920 |
| (α/β) | 0.25 | 0.25 |

<Production Example of Magnetic Core Particles>

[Step 1: Weighing and Mixing Step]

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 parts |

The ferrite starting material was weighed so that the above materials had the above composition ratios. Thereafter, the whole was pulverized and mixed for 5 hours in a dry vibration mill using stainless beads having a ⅛ inch diameter.

[Step 2: Pre-Firing Step]

The obtained pulverized product was formed into pellets about 1 mm square, using a roller compactor. Coarse powder was removed from the pellets using a vibrating sieve having a mesh opening of 3 mm, and fine powder was removed using a vibrating sieve having a mesh opening of 0.5 mm. Thereafter, firing was performed at a temperature of 1000° C. for 4 hours, in a nitrogen atmosphere (oxygen concentration 0.01 vol %), using a burner-type firing furnace, to produce pre-fired ferrite. The composition of the obtained pre-fired ferrite was as described below.

$$(MnO)_a(MgO)_b(SrO)_c(Fe_2O_3)_d.$$

In the above formula, a=0.257, b=0.117, c=0.007 and d=0.393.

[Step 3: Pulverization Step]

After pulverization in a crusher to about 0.3 mm, 30 parts of water were added to 100 parts of the pre-fired ferrite, and the whole was pulverized in a wet ball mill for 1 hour using zirconia beads having a ⅛ inch diameter. The resulting slurry was further pulverized for 4 hours in a wet ball mill using alumina beads having a 1/16 inch diameter, to yield a ferrite slurry (finely pulverized product of pre-fired ferrite).

[Step 4: Granulating Step]

To the ferrite slurry, 1.0 parts of an ammonium polycarboxylate as a dispersion agent and 2.0 parts of polyvinyl alcohol as a binder, with respect to 100 parts of the pre-fired ferrite, were added. This resulting mixture was followed by granulation into spherical particles using a spray dryer (by Ohkawara Kakohki Co., Ltd.). The granularity of the obtained particles was adjusted, and thereafter the particles were heated for 2 hours at a temperature of 650° C., in a rotary kiln, to remove organic components of the dispersant and of the binder.

[Step 5: Firing Process]

In order to control the firing atmosphere, the temperature was raised over 2 hours from room temperature up to a temperature of 1300° C., in a nitrogen atmosphere (oxygen concentration 1.00 vol %) in an electric furnace. This was followed by firing for 4 hours at a temperature of 1150° C. Thereafter, the temperature was lowered down to 60° C. over 4 hours, to revert the nitrogen atmosphere to an air atmosphere, and the resulting product was retrieved at a temperature of 40° C. or lower.

[Step 6: Sorting Step]

After crushing of the aggregated particles, the obtained low magnetic product was cut by magnetic separation, and coarse particles were removed through sifting using a sieve with a mesh opening of 250 μm, to yield magnetic core particles having a median size of 37.0 μm on a volume distribution basis.

<Preparation of Coating Resin Solution>

| | |
|---|---|
| Cyclohexyl methacrylate monomer | 26.8 mass % |
| Methyl methacrylate monomer | 0.2 mass % |
| Methyl methacrylate macromonomer (macromonomer with a weight-average molecular weight of 5000 having a methacryloyl group at one end) | 8.4 mass % |
| Toluene | 31.3 mass % |
| Methyl ethyl ketone | 31.3 mass % |
| Azobisisobutyronitrile | 2.0 mass % |

Among the above materials, the cyclohexyl methacrylate monomer, methyl methacrylate monomer, methyl methacrylate macromonomer, toluene, and methyl ethyl ketone were charged into a four-neck separable flask equipped with a reflux condenser, a thermometer, a nitrogen inlet tube and a stirrer, whereupon nitrogen gas was introduced to purge the interior of the system with nitrogen gas. Thereafter, the temperature was raised to 80° C., azobisisobutyronitrile was added, and polymerization was allowed to proceed for 5 hours under reflux. Hexane was poured onto the obtained polymer, to precipitate a copolymer, and the precipitate was filtered off, followed by vacuum drying, to yield a coating resin. Then 30 parts of the coating resin were dissolved in 40 parts of toluene and 30 parts of methyl ethyl ketone, to yield a coating resin solution (solids: 30 mass %).

<Preparation of Coating Solution>

| | |
|---|---|
| Coating resin solution (solids concentration 30%) | 33.3 mass % |
| Toluene | 66.4 mass % |
| Carbon black | 0.3 mass % |

(Particle diameter of primary particles: 25 nm; nitrogen adsorption specific surface area: 94 $m^2/g$; DBP oil absorption: 75 mL/100 g)

The materials above were dispersed for 1 hour, in a paint shaker, using zirconia beads having a diameter of 0.5 mm. The obtained dispersion was filtered using a 5.0 μm membrane filter, to yield a coating solution.

<Production Example of Magnetic Carrier>

(Resin Coating Process)

The coating solution was charged into a vacuum degassing-type kneader held at normal temperature, in an amount of 2.5 parts of resin component with respect to 100 parts of the magnetic core particle. Thereafter, the whole was stirred for 15 minutes at a rotational speed of 30 rpm, and once a given amount (80 mass %) or greater of the solvent had volatilized, the temperature was raised to 80° C., while under mixing at reduced pressure, to distill toluene off over 2 hours, followed by cooling. A low magnetic product was separated from the obtained magnetic carrier by magnetic separation, the magnetic carrier was passed through a sieve having a 70 μm opening, and was thereafter classified using an air classifier, to yield a magnetic carrier having a median diameter of 38.2 μm on a volume distribution basis.

Example 1

Herein Toner 1 and the magnetic carrier were mixed, at 0.5 $s^{-1}$ for a rotation time of 5 minutes in a V-shaped mixer (Model V-10, by Tokuju Corporation), at a toner concentration of 10 mass %, to yield Two-component developer 1.

The obtained Two-component developer 1 was used in the evaluation below. The evaluation results are given in Table 3-1.

Toner performance was evaluated in accordance with methods (1) to (3) below.

(1) Image Density Fluctuation

A full-color copier imageRUNNER ADVANCE C5560 (by Canon Inc.) was used as an image-forming apparatus. A cyan station was used as a station.

Developing voltage was initially adjusted so that the toner laid-on level of an FFh image was 0.35 $mg/cm^2$.

"FFh" denotes herein a value obtained by displaying 256 gradations in hexadecimal notation, with OOH as the first of the 256 gradations (white background portion) and FFh as the 256th gradation (solid portion).

An endurance image output test was performed for a 10,000 print run of a solid image with a 5% image Duty in respective environments [NN (temperature 23° C./relative humidity 50%)], [HH (temperature 30° C./relative humidity 80%)] and [NL (temperature 23° C./relative humidity 5%)]. The image density of the solid portion in the first and the 10,000th print of the image output test were measured, and the image density difference was evaluated in accordance with the criteria below. Herein CS-680 plain copy paper (A4, basis weight 68 $g/m^2$, commercially available from Canon Marketing Japan Inc.) was used as the evaluation paper. Reflection density was measured using an X-Rite color reflection densitometer (500 Series: by X-Rite Inc.).

During continuous paper feeding of the 10,000 sheets, the sheets were fed under the same developing conditions and transfer conditions (without calibration) as those of the first sheet.

(Evaluation Criteria)

A: Image density difference is smaller than 0.10

B: Image density difference is from 0.10 to smaller than 0.15

C: Image density difference is from 0.15 to smaller than 0.25

D: Image density difference is 0.25 or greater (2) Fogging

After the endurance image output test in (1) above was over, the copier was allowed to stand in the same environment for one day, and then a solid white image (image density 0, image Duty 0%) was outputted to A3 size paper, and fogging on a white background portion was evaluated.

Herein CS-680 plain copy paper (A3, basis weight 68 $g/m^2$, commercially available from Canon Marketing Japan Inc.) was used as the evaluation paper.

The fogging density was measured at nine central locations of respective regions resulting from dividing one sheet substantially equally into three, both horizontally and vertically (i.e. top, middle, bottom, top left, middle left, bottom left, top right, middle right and bottom right), using a reflection densitometer (model TC-6DS, Tokyo Denshoku Co., Ltd.), and the average value at the nine locations was taken as the fogging density. The results were ranked in accordance with the following evaluation criteria.

A: Fogging density is lower than 1.0

B: Fogging density is from 1.0 to lower than 2.0

C: Fogging density is from 2.0 to lower than 3.0

D: Fogging density is 3.0 or higher (3) Dot Reproducibility

Dot reproducibility before and after output of 10,000 prints of a solid image having a 5% image Duty in respective environments [NN (temperature 23° C./relative humidity 50%)], [HH (temperature 30° C./relative humidity 80%)] and [NL (temperature 23° C./relative humidity 5%)] was evaluated.

A dot image (FFh image) formed with one dot per pixel was created herein. The spot diameter of the laser beam was adjusted so that the surface area per dot on the paper was from 20,000 $\mu m^2$ to 25,000 $\mu m^2$. The surface area of 1000 dots was measured using a digital microscope VHX-500 (lens of wide range zoom lens VH-Z100, by Keyence Corporation). The number average (S) of the dot surface area and the standard deviation (σ) of the dot surface area were calculated, and a dot reproducibility index was calculated in accordance with the expression below.

$$\text{Dot reproducibility index}(I)=\sigma/S\times 100$$

(Evaluation Criteria)

A: I is smaller than 4.0

B: I is from 4.0 to smaller than 6.0

C: I is from 6.0 to smaller than 8.0

D: I is equal to or greater than 8.0

Examples 2 to 26, Comparative Examples 1 to 8

Two-component developers 2 to 34 were obtained in the same way as in Example 1, but using herein Toners 2 to 34.

Evaluations similar to those of Example 1 were carried out using the obtained two-component developers. The evaluation results are given in Table 3-1, Table 3-2 and Table 3-3.

TABLE 3-1

| | Example No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| | Toner No. | | | | | | | | | | | | |
| | 1 | 2 | 3 | 4 | 5 | 6 | 7 | 8 | 9 | 10 | 11 | 12 | 13 |
| NN: Image density fluctuation | A (0.01) | A (0.02) | A (0.02) | A (0.03) | A (0.03) | A (0.05) | A (0.05) | A (0.06) | A (0.05) | A (0.06) | A (0.06) | A (0.07) | A (0.07) |
| NN: Fogging | A (0.2) | A (0.2) | A (0.2) | A (0.3) | A (0.3) | A (0.3) | A (0.3) | A (0.3) | A (0.3) | A (0.4) | A (0.4) | A (0.4) | A (0.5) |
| NN: Dot reproducibility | A (0.5) | A (0.5) | A (0.5) | A (0.7) | A (0.7) | A (0.8) | A (0.8) | A (1.1) | A (1.0) | A (1.0) | A (1.0) | A (1.8) | A (2.3) |
| HH: Image density fluctuation | A (0.02) | A (0.01) | A (0.01) | A (0.02) | A (0.02) | A (0.03) | A (0.03) | A (0.04) | A (0.04) | A (0.05) | A (0.08) | B (0.11) | C (0.19) |
| HH: Fogging | A (0.3) | A (0.3) | A (0.3) | A (0.3) | A (0.3) | A (0.3) | A (0.3) | A (0.3) | A (0.3) | B (1.1) | B (1.3) | B (1.6) | B (1.6) |
| HH: Dot reproducibility | A (0.4) | A (0.4) | A (0.4) | A (0.6) | A (0.6) | A (0.6) | A (0.6) | A (0.6) | A (0.6) | A (0.5) | A (0.6) | A (0.5) | A (0.6) |
| NL: Image density fluctuation | A (0.03) | A (0.03) | A (0.03) | A (0.06) | A (0.08) | B (0.12) | B (0.13) | C (0.22) | C (0.20) | C (0.21) | C (0.19) | C (0.18) | C (0.17) |
| NL: Fogging | A (0.5) | B (1.2) | B (1.1) | C (2.4) | C (2.3) | C (2.3) | C (2.3) | C (2.3) | C (2.5) | C (2.2) | C (2.1) | C (2.2) | C (2.1) |
| NL: Dot reproducibility | A (1.2) | A (1.2) | A (1.2) | A (1.5) | A (1.7) | A (1.8) | A (1.6) | A (2.0) | A (1.5) | A (1.9) | A (2.2) | A (2.2) | A (2.5) |

TABLE 3-2

| | Example No. | | | | | | | | | | | | |
|---|---|---|---|---|---|---|---|---|---|---|---|---|---|
| | 14 | 15 | 16 | 17 | 18 | 19 | 20 | 21 | 22 | 23 | 24 | 25 | 26 |
| | Toner No. | | | | | | | | | | | | |
| | 14 | 15 | 16 | 17 | 18 | 19 | 20 | 21 | 22 | 23 | 24 | 25 | 26 |
| NN: Image density fluctuation | A (0.06) | A (0.07) | A (0.06) | A (0.07) | B (0.11) | B (0.12) | B (0.13) | B (0.12) | A (0.05) | A (0.07) | A (0.05) | A (0.05) | A (0.08) |
| NN: Fogging | A (0.5) | A (0.5) | B (1.2) | B (1.4) | A (0.5) | A (0.6) | A (0.6) | A (0.5) | A (0.5) | A (0.5) | A (0.6) | A (0.6) | A (0.6) |
| NN: Dot reproducibility | B (4.4) | B (5.0) | B (4.8) | B (4.6) | B (5.3) | B (5.2) | B (4.6) | B (4.1) | A (2.1) | A (2.4) | A (3.0) | A (3.3) | A (2.8) |
| HH: Image density fluctuation | C (0.18) | C (0.21) | C (0.20) | C (0.20) | C (0.20) | C (0.20) | C (0.18) | C (0.19) | C (0.20) | C (0.21) | C (0.22) | C (0.23) | C (0.24) |
| HH: Fogging | B (1.6) | B (1.7) | B (1.8) | B (1.8) | B (1.6) | B (1.8) | B (1.6) | B (1.6) | B (1.6) | B (1.6) | B (1.6) | B (1.5) | B (1.5) |
| HH: Dot reproducibility | A (0.6) | A (0.7) | A (0.7) | A (0.7) | A (0.7) | A (0.8) | A (0.7) | A (0.6) | A (2.6) | A (3.3) | B (4.3) | B (4.8) | B (5.0) |
| NL: Image density fluctuation | C (0.16) | C (0.16) | C (0.15) | C (0.15) | C (0.16) | C (0.16) | C (0.16) | C (0.17) | C (0.17) | C (0.16) | C (0.17) | C (0.17) | C (0.16) |
| NL: Fogging | C (2.1) | C (2.2) | C (2.4) | C (2.3) | B (1.3) | C (2.2) | C (2.4) | C (2.2) | C (2.0) | C (2.1) | C (2.0) | C (2.1) | C (2.1) |
| NL: Dot reproducibility | A (2.8) | A (3.0) | A (3.3) | A (3.0) | A (2.8) | A (3.2) | A (2.8) | A (3.6) | B (4.7) | B (5.0) | B (4.9) | B (5.3) | B (5.8) |

TABLE 3-3

| | Comparative Example No. | | | | | | | |
|---|---|---|---|---|---|---|---|---|
| | 1 | 2 | 3 | 4 | 5 | 6 | 7 | 8 |
| | Toner No. | | | | | | | |
| | 27 | 28 | 29 | 30 | 31 | 32 | 33 | 34 |
| NN: Image density fluctuation | D (0.25) | D (0.25) | D (0.26) | D (0.25) | C (0.18) | C (0.16) | D (0.27) | D (0.28) |
| NN: Fogging | C (2.8) | C (2.7) | C (2.7) | C (2.8) | D (3.3) | D (3.2) | C (2.6) | C (2.6) |
| NN: Dot reproducibility | D (8.3) | D (8.2) | D (8.3) | D (8.3) | D (8.2) | D (8.3) | D (8.1) | D (8.0) |

TABLE 3-3-continued

| | Comparative Example No. | | | | | | | |
|---|---|---|---|---|---|---|---|---|
| | 1 | 2 | 3 | 4 | 5 | 6 | 7 | 8 |
| | Toner No. | | | | | | | |
| | 27 | 28 | 29 | 30 | 31 | 32 | 33 | 34 |
| HH: Image density fluctuation | D (0.34) | D (0.30) | D (0.32) | D (0.38) | D (0.31) | D (0.36) | D (0.37) | D (0.35) |
| HH: Fogging | D (3.5) | D (3.3) | D (3.8) | D (3.0) | D (3.2) | D (3.6) | C (2.9) | C (2.8) |
| HH: Dot reproducibility | D (8.9) | D (8.6) | D (8.9) | D (8.1) | D (8.9) | D (8.8) | D (8.1) | D (8.0) |
| NL: Image density fluctuation | D (0.25) | D (0.26) | D (0.28) | D (0.31) | C (0.22) | C (0.24) | C (0.23) | C (0.23) |
| NL: Fogging | D (3.0) | D (3.0) | D (3.2) | D (3.3) | C (2.1) | C (2.3) | C (2.5) | C (2.6) |
| NL: Dot reproducibility | D (9.6) | D (9.4) | D (9.1) | D (9.5) | D (9.2) | D (9.0) | D (9.4) | D (9.5) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-159465, filed Aug. 28, 2018, which is hereby incorporated by reference herein in its entirety.

What is claimed is:

1. A toner, comprising:

a toner particle that contains a binder resin; and an inorganic fine particle, the inorganic fine particle containing aggregated particles that contain primary particles of at least one metal salt selected from the group consisting of titanate metal salts and zirconate metal salts;

the aggregated particles contain a reaction product of the primary particles of the metal salt and a binder agent comprising an organosilane compounds represented by Formula (1)

$$R_mSiY_n \quad (1)$$

where R represents an alkoxy group; in represents an integer of 1 to 3; Y represents an alkyl group having 1 to 10 carbon atoms, a phenyl group, a vinyl group, an epoxy group, a methacryl group or an acryl group; and n is an integer of 1 to 3, with the proviso that m+n=4;

the primary particles having a number-average particle diameter of 15 to 55 nm; and the aggregated particles having an aggregation diameter of 80 to 300 nm and a volume resistivity of $2\times10^9$ to $2\times10^{13}$ Ω·cm, wherein the aggregated particles cover a surface of the toner particle, and a coverage ratio of the aggregated particles with respect to the surface of the toner particle is 0.3 to 10.0 area %.

2. The toner of claim 1, wherein the aggregated particles contain primary particles of at least one metal salt selected from the group consisting of strontium titanate, calcium titanate, magnesium titanate, strontium zirconate, calcium zirconate, and magnesium zirconate.

3. The toner of claim 1, wherein the aggregated particles contain a reaction product of the primary particles of the metal salt and at least one compound selected from the group consisting of fluorine-containing silane compounds and organosilane compounds represented by Formula (1).

4. The toner of claim 3, wherein an average circularity of the aggregated particles is 0.780 to 0.910.

5. The toner of claim 1, wherein a ratio of the number-average particle diameter of the primary particles of the metal salt with respect to the aggregation diameter of the aggregated particles is 0.15 to 0.45.

6. The toner of claim 1, wherein the coverage ratio of the aggregated particles with respect to the surface of the toner particle is 0.5 to 5.0 area %.

7. The toner of claim 1, wherein the content of the aggregated particles is 0.10 to 10.00 parts by mass with respect to 100 parts by mass of the toner particle.

8. The toner of claim 1, wherein the binder agent comprises at least one compound selected from the group consisting of isobutyltrimethoxysilane and octyltrimethoxysilane.

9. The toner of claim 1, wherein the binder agent comprises a mixture of isobutyltrimethoxysilane and trimethoxy(3,3,3-trifluoropropyl)silane.

* * * * *